US007073595B2

(12) United States Patent
Zupanick et al.

(10) Patent No.: US 7,073,595 B2
(45) Date of Patent: Jul. 11, 2006

(54) METHOD AND SYSTEM FOR CONTROLLING PRESSURE IN A DUAL WELL SYSTEM

(75) Inventors: Joseph A. Zupanick, Pineville, WV (US); Frank Merendino, Jr., Bristol, TN (US)

(73) Assignee: CDX Gas, LLC, Dallas, TX (US)

( * ) Notice: Subject to any disclaimer, the term of this patent is extended or adjusted under 35 U.S.C. 154(b) by 355 days.

(21) Appl. No.: 10/244,082

(22) Filed: Sep. 12, 2002

(65) Prior Publication Data

US 2005/0115709 A1 Jun. 2, 2005

(51) Int. Cl.
*E21B 43/18* (2006.01)
*E21B 43/30* (2006.01)

(52) U.S. Cl. ..... 166/370; 166/50; 166/250.15; 166/268; 166/312; 166/313

(58) Field of Classification Search ..... 166/268, 166/311, 312, 313, 369, 370, 50, 250.15, 166/250.07

See application file for complete search history.

(56) References Cited

U.S. PATENT DOCUMENTS

| | | | |
|---|---|---|---|
| 54,144 | A | 4/1866 | Hamar |
| 274,740 | A | 3/1883 | Douglass |
| 526,708 | A | 10/1894 | Horton |
| 639,036 | A | 12/1899 | Heald |
| 1,189,560 | A | 7/1916 | Gondos |
| 1,285,347 | A | 11/1918 | Otto |
| 1,467,480 | A | 9/1923 | Hogue |
| 1,485,615 | A | 3/1924 | Jones |
| 1,488,106 | A | 3/1924 | Fitzpatrick |

(Continued)

FOREIGN PATENT DOCUMENTS

| | | | |
|---|---|---|---|
| AU | 85/49964 | A | 11/1986 |
| CA | 2210866 | | 1/1998 |
| DE | 197 25 996 | A1 | 1/1998 |
| EP | 0 819 834 | A1 | 1/1998 |
| EP | 0 875 661 | A1 | 11/1998 |
| EP | 0 952 300 | A1 | 10/1999 |
| EP | 1 316 673 | A2 | 6/2003 |

(Continued)

OTHER PUBLICATIONS

Notification of Transmittal of the International Search Report or the Declaration (PCT Rule 44.1) mailed Nov. 6, 2003 (8 pages) re International Application No. PCT/US 03/21626, filed Jul. 11, 2003.

Notification of Transmittal of the International Search Report or the Declaration (PCT Rule 44.1) mailed Nov. 5, 2003 (8 pages) re International Application No. PCT/US 03/21627, filed Jul. 11, 2003.

(Continued)

*Primary Examiner*—David Bagnell
*Assistant Examiner*—Jennifer Gay
(74) *Attorney, Agent, or Firm*—Fish & Richardson P.C.

(57) ABSTRACT

A method for controlling pressure of a dual well system includes drilling a substantially vertical well bore from a surface to a subterranean zone and drilling an articulated well bore from the surface to the subterranean zone using a drill string. The articulated well bore is horizontally offset from the substantially vertical well bore at the surface and intersects the substantially vertical well bore. The method includes drilling a drainage bore into the subterranean zone. The method includes pumping a drilling fluid through the drill string when drilling the drainage bore. The method includes pumping a pressure fluid down the substantially vertical well bore when drilling the drainage bore. The pressure fluid mixes with the drilling fluid to form a fluid mixture returning up the articulated well bore which forms a frictional pressure that resists fluid flow from the subterranean zone.

37 Claims, 3 Drawing Sheets

U.S. PATENT DOCUMENTS

| | | | | | |
|---|---|---|---|---|---|
| 1,520,737 | A | | 12/1924 | Wright | |
| 1,674,392 | A | | 6/1928 | Flansburg | |
| 1,777,961 | A | | 10/1930 | Capeliuschnicoff | |
| 2,018,285 | A | | 10/1935 | Schweitzer et al. | 166/21 |
| 2,069,482 | A | | 2/1937 | Seay | 255/76 |
| 2,150,228 | A | | 3/1939 | Lamb | 166/10 |
| 2,169,718 | A | | 8/1939 | Boll et al. | 255/24 |
| 2,335,085 | A | | 11/1943 | Roberts | 251/197 |
| 2,450,223 | A | | 9/1948 | Barbour | 255/76 |
| 2,490,350 | A | | 12/1949 | Grable | 166/4 |
| 2,679,903 | A | | 6/1954 | McGowen, Jr. et al. | 166/1 |
| 2,726,063 | A | | 12/1955 | Ragland et al. | 255/1.8 |
| 2,726,847 | A | | 12/1955 | McCune et al. | 255/1.6 |
| 2,783,018 | A | | 2/1957 | Lytle | 251/25 |
| 2,797,893 | A | | 7/1957 | McCune et al. | |
| 2,847,189 | A | | 8/1958 | Shook | 255/76 |
| 2,911,008 | A | | 11/1959 | Du Bois | 137/625.31 |
| 2,934,904 | A | | 5/1960 | Hendrix | |
| 2,980,142 | A | | 4/1961 | Turak | 137/637.3 |
| 3,163,211 | A | | 12/1964 | Henley | |
| 3,208,537 | A | | 9/1965 | Scarborough | 175/53 |
| 3,347,595 | A | * | 10/1967 | Dahms et al. | 299/4 |
| 3,385,382 | A | | 5/1968 | Canalizo et al. | |
| 3,443,648 | A | | 5/1969 | Howard | 175/103 |
| 3,473,571 | A | | 10/1969 | Dugay | 137/625.4 |
| 3,503,377 | A | | 3/1970 | Beatenbough et al. | 123/117 |
| 3,528,516 | A | | 9/1970 | Brown | 175/267 |
| 3,530,675 | A | | 9/1970 | Turzillo | 61/35 |
| 3,534,822 | A | | 10/1970 | Campbell et al. | |
| 3,578,077 | A | | 5/1971 | Glenn, Jr. et al. | |
| 3,582,138 | A | | 6/1971 | Loofbourow et al. | |
| 3,587,743 | A | | 6/1971 | Howard | |
| 3,684,041 | A | | 8/1972 | Kammerer, Jr. et al. | 175/267 |
| 3,692,041 | A | | 9/1972 | Bondi | 137/238 |
| 3,744,565 | A | | 7/1973 | Brown | |
| 3,757,876 | A | | 9/1973 | Pereau | 175/267 |
| 3,757,877 | A | | 9/1973 | Leathers | 175/269 |
| 3,763,652 | A | | 10/1973 | Rinta | |
| 3,800,830 | A | | 4/1974 | Etter | 137/625.41 |
| 3,809,519 | A | | 5/1974 | Garner | 425/245 |
| 3,825,081 | A | | 7/1974 | McMahon | 175/73 |
| 3,828,867 | A | | 8/1974 | Elwood | 175/45 |
| 3,874,413 | A | | 4/1975 | Valdez | 137/625.47 |
| 3,887,008 | A | | 6/1975 | Canfield | 166/267 |
| 3,902,322 | A | | 9/1975 | Watanabe | 61/35 |
| 3,907,045 | A | | 9/1975 | Dahl et al. | 175/45 |
| 3,934,649 | A | | 1/1976 | Pasini, III et al. | 166/254 |
| 3,957,082 | A | | 5/1976 | Fuson et al. | 137/625.41 |
| 3,961,824 | A | | 6/1976 | Van Eek et al. | 299/17 |
| 4,011,890 | A | | 3/1977 | Andersson | 137/625.4 |
| 4,020,901 | A | | 5/1977 | Pisio et al. | |
| 4,022,279 | A | | 5/1977 | Driver | 166/271 |
| 4,030,310 | A | | 6/1977 | Schirtzinger | |
| 4,037,658 | A | | 7/1977 | Anderson | 166/272 |
| 4,060,130 | A | | 11/1977 | Hart | |
| 4,073,351 | A | | 2/1978 | Baum | 175/14 |
| 4,089,374 | A | | 5/1978 | Terry | 166/259 |
| 4,116,012 | A | | 9/1978 | Abe et al. | 405/238 |
| 4,134,463 | A | | 1/1979 | Allen | 175/53 |
| 4,136,996 | A | | 1/1979 | Burns | |
| 4,151,880 | A | | 5/1979 | Vann | |
| 4,156,437 | A | | 5/1979 | Chivens et al. | 137/554 |
| 4,169,510 | A | | 10/1979 | Meigs | 175/65 |
| 4,182,423 | A | | 1/1980 | Ziebarth et al. | |
| 4,189,184 | A | | 2/1980 | Green | 299/8 |
| 4,220,203 | A | | 9/1980 | Steeman | 166/271 |
| 4,221,433 | A | | 9/1980 | Jacoby | 299/4 |
| 4,222,611 | A | | 9/1980 | Larson et al. | |
| 4,224,989 | A | | 9/1980 | Blount | 166/250 |
| 4,226,475 | A | | 10/1980 | Frosch et al. | |
| 4,257,650 | A | | 3/1981 | Allen | 299/2 |
| 4,278,137 | A | | 7/1981 | Van Eek | 175/267 |
| 4,283,088 | A | | 8/1981 | Tabakov et al. | 299/2 |
| 4,296,785 | A | | 10/1981 | Vitello et al. | 141/105 |
| 4,299,295 | A | | 11/1981 | Gossard | 175/45 |
| 4,303,127 | A | | 12/1981 | Freel et al. | 166/266 |
| 4,305,464 | A | | 12/1981 | Masszi | 166/370 |
| 4,312,377 | A | | 1/1982 | Knecht | 137/625.19 |
| 4,317,492 | A | | 3/1982 | Summers et al. | 175/79 |
| 4,328,577 | A | | 5/1982 | Abbott et al. | 370/84 |
| 4,333,539 | A | | 6/1982 | Lyons et al. | 175/61 |
| 4,366,988 | A | | 1/1983 | Bodine | 299/14 |
| 4,372,398 | A | | 2/1983 | Kuckes | 175/45 |
| 4,386,665 | A | | 6/1983 | Dellinger | 175/61 |
| 4,390,067 | A | | 6/1983 | Willman | 166/245 |
| 4,396,076 | A | | 8/1983 | Inoue | 175/265 |
| 4,397,360 | A | | 8/1983 | Schmidt | 175/61 |
| 4,401,171 | A | | 8/1983 | Fuchs | 175/267 |
| 4,407,376 | A | | 10/1983 | Inoue | 175/267 |
| 4,415,205 | A | | 11/1983 | Rehm et al. | |
| 4,417,829 | A | | 11/1983 | Berezoutzky | |
| 4,422,505 | A | | 12/1983 | Collins | |
| 4,437,706 | A | | 3/1984 | Johnson | 299/7 |
| 4,442,896 | A | | 4/1984 | Reale et al. | 166/278 |
| 4,463,988 | A | | 8/1984 | Bouck et al. | |
| 4,494,616 | A | | 1/1985 | McKee | 175/67 |
| 4,502,733 | A | | 3/1985 | Grubb | |
| 4,512,422 | A | | 4/1985 | Knisley | 175/99 |
| 4,519,463 | A | | 5/1985 | Schuh | 175/61 |
| 4,527,639 | A | | 7/1985 | Dickinson, III et al. | 175/61 |
| 4,532,986 | A | * | 8/1985 | Mims et al. | 166/50 |
| 4,533,182 | A | | 8/1985 | Richards | |
| 4,536,035 | A | | 8/1985 | Huffman et al. | |
| 4,544,037 | A | | 10/1985 | Terry | 166/369 |
| 4,558,744 | A | | 12/1985 | Gibb | 166/335 |
| 4,565,252 | A | | 1/1986 | Campbell et al. | 175/269 |
| 4,573,541 | A | | 3/1986 | Josse et al. | 175/78 |
| 4,599,172 | A | | 7/1986 | Gardes | 210/314 |
| 4,600,061 | A | | 7/1986 | Richards | 175/62 |
| 4,603,592 | A | | 8/1986 | Siebold et al. | |
| 4,605,076 | A | | 8/1986 | Goodhart | 175/61 |
| 4,611,855 | A | | 9/1986 | Richards | 299/2 |
| 4,618,009 | A | | 10/1986 | Carter et al. | 175/267 |
| 4,638,949 | A | | 1/1987 | Mancel | 239/307 |
| 4,646,836 | A | | 3/1987 | Goodhart | 166/303 |
| 4,651,836 | A | | 3/1987 | Richards | |
| 4,662,440 | A | | 5/1987 | Harmon et al. | |
| 4,674,579 | A | | 6/1987 | Geller et al. | 175/45 |
| 4,676,313 | A | | 6/1987 | Rinaldi | |
| 4,702,314 | A | | 10/1987 | Huang et al. | 166/245 |
| 4,705,109 | A | | 11/1987 | Ledent et al. | |
| 4,705,431 | A | | 11/1987 | Gadelle et al. | 405/267 |
| 4,715,440 | A | | 12/1987 | Boxell et al. | 166/100 |
| 4,718,485 | A | | 1/1988 | Brown et al. | |
| 4,727,937 | A | | 3/1988 | Shum et al. | |
| 4,753,485 | A | | 6/1988 | Goodhart | |
| 4,754,808 | A | | 7/1988 | Harmon et al. | |
| 4,754,819 | A | | 7/1988 | Dellinger | 175/61 |
| 4,756,367 | A | | 7/1988 | Puri et al. | 166/263 |
| 4,763,734 | A | | 8/1988 | Dickinson et al. | 175/61 |
| 4,773,488 | A | | 9/1988 | Bell et al. | 175/61 |
| 4,776,638 | A | | 10/1988 | Hahn | |
| 4,830,105 | A | | 5/1989 | Petermann | 166/241 |
| 4,832,122 | A | | 5/1989 | Corey et al. | |
| 4,836,611 | A | | 6/1989 | El-Saie | 299/7 |
| 4,842,081 | A | | 6/1989 | Parant | 175/23 |
| 4,844,182 | A | | 7/1989 | Tolle | 175/215 |
| 4,852,666 | A | | 8/1989 | Brunet et al. | 175/61 |
| 4,883,122 | A | | 11/1989 | Puri et al. | 166/248 |
| 4,889,186 | A | | 12/1989 | Hanson et al. | |
| 4,978,172 | A | | 12/1990 | Schwoebel et al. | 299/12 |

5,016,709 A 5/1991 Combe et al.
5,016,710 A * 5/1991 Renard et al. ..... 166/245
5,033,550 A 7/1991 Johnson et al.
5,035,605 A 7/1991 Dinerman et al. ..... 481/18
5,036,921 A 8/1991 Pittard et al. ..... 166/298
5,074,360 A 12/1991 Guinn ..... 166/281
5,074,365 A 12/1991 Kuckes ..... 175/40
5,074,366 A 12/1991 Karlsson et al. ..... 175/76
5,082,054 A 1/1992 Kiamanesh ..... 166/248
5,111,893 A 5/1992 Kvello-Aune ..... 175/258
5,115,872 A 5/1992 Brunet et al.
5,127,457 A 7/1992 Stewart et al.
5,135,058 A 8/1992 Millgard et al. ..... 175/71
5,148,875 A 9/1992 Karlsson et al. ..... 175/62
5,148,877 A 9/1992 MacGregor
5,165,491 A 11/1992 Wilson ..... 175/62
5,168,942 A 12/1992 Wydrinski ..... 175/50
5,174,374 A 12/1992 Hailey ..... 166/55.8
5,193,620 A 3/1993 Braddick ..... 166/382
5,194,859 A 3/1993 Warren ..... 340/853.4
5,197,553 A 3/1993 Leturno ..... 175/57
5,197,783 A 3/1993 Theimer et al. ..... 299/17
5,199,496 A 4/1993 Redus et al. ..... 166/366
5,201,817 A 4/1993 Hailey ..... 175/269
5,217,076 A 6/1993 Masek ..... 166/303
5,226,495 A 7/1993 Jennings, Jr. ..... 166/278
5,240,350 A 8/1993 Yamaguchi et al. ..... 405/143
5,242,017 A 9/1993 Hailey ..... 166/55.8
5,242,025 A 9/1993 Neill et al. ..... 175/26
5,246,273 A 9/1993 Rosar ..... 299/4
5,255,741 A 10/1993 Alexander ..... 166/278
5,271,472 A 12/1993 Leturno ..... 175/107
5,287,926 A 2/1994 Grupping
5,289,888 A 3/1994 Talley
5,301,760 A 4/1994 Graham ..... 175/61
5,343,965 A 9/1994 Talley et al.
5,355,967 A 10/1994 Mueller et al.
5,363,927 A 11/1994 Frank ..... 175/67
5,385,205 A 1/1995 Hailey ..... 166/55.8
5,394,950 A 3/1995 Gardes ..... 175/45
5,402,851 A * 4/1995 Baiton ..... 166/369
5,411,082 A 5/1995 Kennedy ..... 166/181
5,411,085 A 5/1995 Moore et al. ..... 166/242
5,411,088 A 5/1995 LeBlanc et al. ..... 166/265
5,411,104 A 5/1995 Stanley ..... 175/65
5,411,105 A 5/1995 Gray ..... 175/69
5,431,220 A 7/1995 Lennon et al. ..... 166/55.7
5,431,482 A 7/1995 Russo
5,435,400 A 7/1995 Smith ..... 175/61
5,447,416 A 9/1995 Wittrisch ..... 417/442
5,450,902 A 9/1995 Matthews ..... 166/268
5,454,419 A 10/1995 Vloedman ..... 166/277
5,458,209 A 10/1995 Hayes et al. ..... 175/61
5,462,116 A 10/1995 Carroll ..... 166/249
5,462,120 A 10/1995 Gondouin ..... 166/380
5,469,155 A 11/1995 Archambeault et al. . 340/853.4
5,477,923 A 12/1995 Jordan, Jr. et al. ..... 66/313
5,485,089 A 1/1996 Kuckes ..... 324/346
5,494,121 A 2/1996 Nackerud ..... 175/263
5,499,687 A 3/1996 Lee ..... 175/317
5,501,273 A 3/1996 Puri ..... 166/252.5
5,501,279 A 3/1996 Garg et al. ..... 166/372
5,584,605 A 12/1996 Beard et al. ..... 405/128
5,613,242 A 3/1997 Oddo ..... 588/17
5,615,739 A 4/1997 Dallas ..... 166/306
5,653,286 A 8/1997 McCoy et al. ..... 166/105.5
5,669,444 A 9/1997 Riese et al. ..... 166/263
5,676,207 A 10/1997 Simon et al.
5,680,901 A 10/1997 Gardes ..... 166/313
5,690,390 A 11/1997 Bithell ..... 299/4
5,697,445 A 12/1997 Graham
5,706,871 A 1/1998 Anderson et al. ..... 141/59
5,720,356 A 2/1998 Gardes ..... 175/62
5,727,629 A 3/1998 Blizzard, Jr. et al. ..... 166/298
5,735,350 A 4/1998 Longbottom et al. ..... 166/313
5,771,976 A * 6/1998 Talley ..... 166/370
5,775,433 A 7/1998 Hammett et al. ..... 166/98
5,775,443 A 7/1998 Lott
5,785,133 A 7/1998 Murray et al. ..... 175/61
5,832,958 A 11/1998 Cheng ..... 137/625.41
5,853,054 A 12/1998 McGarian et al. ..... 175/267
5,853,056 A 12/1998 Landers ..... 175/424
5,853,224 A 12/1998 Riese
5,863,283 A 1/1999 Gardes ..... 588/250
5,868,202 A 2/1999 Hsu ..... 166/256
5,868,210 A 2/1999 Johnson et al. ..... 175/40
5,879,057 A 3/1999 Schwoebel et al. ..... 299/17
5,884,704 A 3/1999 Longbottom et al. ..... 16/313
5,917,325 A 6/1999 Smith ..... 324/326
5,934,390 A 8/1999 Uthe ..... 175/67
5,938,004 A 8/1999 Roberts et al. ..... 198/812
5,941,307 A 8/1999 Tubel
5,944,107 A 8/1999 Ohmer
5,957,539 A 9/1999 Durup et al. ..... 299/4
5,971,074 A 10/1999 Longbottom et al. ..... 166/313
5,988,278 A 11/1999 Johnson
5,992,524 A 11/1999 Graham
6,012,520 A 1/2000 Yu et al. ..... 166/245
6,015,012 A 1/2000 Reddick ..... 166/313
6,019,173 A 2/2000 Saurer et al.
6,024,171 A 2/2000 Montgomery et al. ..... 166/308
6,030,048 A 2/2000 Hsu
6,050,335 A 4/2000 Parsons ..... 166/272.3
6,056,059 A 5/2000 Ohmer ..... 166/313
6,062,306 A 5/2000 Gano et al.
6,065,550 A 5/2000 Gardes ..... 175/62
6,065,551 A 5/2000 Gourley et al.
6,079,495 A 6/2000 Ohmer
6,089,322 A 7/2000 Kelley et al.
6,119,771 A 9/2000 Gano et al. ..... 166/50
6,119,776 A 9/2000 Graham et al.
6,135,208 A 10/2000 Gano et al. ..... 166/313
6,170,571 B1 1/2001 Ohmer
6,179,054 B1 1/2001 Stewart ..... 166/105.5
6,189,616 B1 2/2001 Gano et al.
6,192,988 B1 2/2001 Tubel
6,199,633 B1 3/2001 Longbottom
6,209,636 B1 4/2001 Roberts et al. ..... 166/117.6
6,237,284 B1 5/2001 Erickson
6,244,340 B1 6/2001 McGlothen et al.
6,247,532 B1 6/2001 Ohmer
6,263,965 B1 7/2001 Schmidt et al.
6,279,658 B1 8/2001 Donovan et al.
6,280,000 B1 * 8/2001 Zupanick ..... 299/12
6,283,216 B1 9/2001 Ohmer
6,318,457 B1 11/2001 Den Boer et al.
6,349,769 B1 2/2002 Ohmer ..... 166/313
6,357,523 B1 * 3/2002 Zupanick ..... 166/52
6,357,530 B1 3/2002 Kennedy et al. ..... 166/369
6,425,448 B1 * 7/2002 Zupanick et al. ..... 175/61
6,439,320 B1 * 8/2002 Zupanick ..... 175/61
6,450,256 B1 9/2002 Mones ..... 166/250.01
6,454,000 B1 9/2002 Zupanick
6,457,540 B1 10/2002 Gardes
6,470,978 B1 10/2002 Trueman et al.
6,491,101 B1 12/2002 Ohmer
6,497,556 B1 12/2002 Zupanick et al.
6,554,063 B1 4/2003 Ohmer
6,557,628 B1 5/2003 Ohmer
6,564,867 B1 5/2003 Ohmer
6,566,649 B1 5/2003 Mickael ..... 250/269.2
6,571,888 B1 6/2003 Comeau et al. ..... 175/61

| | | | | |
|---|---|---|---|---|
| 6,575,255 | B1 | 6/2003 | Rial et al. | |
| 6,577,129 | B1 | 6/2003 | Thompson et al. | 324/338 |
| 6,585,061 | B1 | 7/2003 | Radzinski et al. | 175/45 |
| 6,590,202 | B1 | 7/2003 | Mickael | 250/269.3 |
| 6,591,903 | B1 | 7/2003 | Ingle et al. | 166/50 |
| 6,591,922 | B1 | 7/2003 | Rial et al. | |
| 6,595,301 | B1 | 7/2003 | Diamond et al. | |
| 6,595,302 | B1 | 7/2003 | Diamond et al. | |
| 6,604,910 | B1 | 8/2003 | Zupanick | |
| 6,607,042 | B1 | 8/2003 | Hoyer et al. | 175/38 |
| 6,636,159 | B1 | 10/2003 | Winnacker | 340/854.3 |
| 6,639,210 | B1 | 10/2003 | Odom et al. | 250/269.6 |
| 6,644,422 | B1 | 11/2003 | Rial et al. | |
| 6,646,441 | B1 | 11/2003 | Thompson et al. | |
| 6,653,839 | B1 | 11/2003 | Yuratich et al. | 324/355 |
| 6,662,870 | B1 * | 12/2003 | Zupanick et al. | 166/245 |
| 6,679,322 | B1 * | 1/2004 | Zupanick | 166/50 |
| 6,722,452 | B1 | 4/2004 | Rial et al. | |
| 6,758,279 | B1 | 7/2004 | Moore et al. | |
| 2001/0010432 | A1 | 8/2001 | Zupanick | |
| 2001/0015574 | A1 | 8/2001 | Zupanick et al. | |
| 2002/0043404 | A1 | 4/2002 | Trueman et al. | |
| 2002/0050358 | A1 | 5/2002 | Algeroy et al. | 166/313 |
| 2002/0074120 | A1 | 6/2002 | Scott | 166/313 |
| 2002/0074122 | A1 | 6/2002 | Kelley et al. | |
| 2002/0096336 | A1 | 7/2002 | Zupanick et al. | |
| 2003/0062198 | A1 | 4/2003 | Gardes | 175/61 |
| 2003/0066686 | A1 | 4/2003 | Conn | 175/57 |
| 2003/0075334 | A1 | 4/2003 | Haugen et al. | 166/313 |
| 2003/0164253 | A1 | 9/2003 | Trueman et al. | |
| 2003/0217842 | A1 | 11/2003 | Zupanick et al. | |
| 2003/0221836 | A1 | 12/2003 | Gardes | |
| 2004/0011560 | A1 | 1/2004 | Rial et al. | |
| 2004/0020655 | A1 | 2/2004 | Rusby et al. | |
| 2004/0031609 | A1 | 2/2004 | Zupanick | |
| 2004/0033557 | A1 | 2/2004 | Scott et al. | |
| 2004/0050552 | A1 | 3/2004 | Zupanick | |
| 2004/0050554 | A1 | 3/2004 | Zupanick et al. | |
| 2004/0055787 | A1 | 3/2004 | Zupanick | |
| 2004/0060351 | A1 | 4/2004 | Gunter et al. | |
| 2004/0140129 | A1 | 7/2004 | Gardes | |
| 2004/0226719 | A1 | 11/2004 | Morgan et al. | |
| 2005/0133219 | A1 | 6/2005 | Zupanick | |

FOREIGN PATENT DOCUMENTS

| | | |
|---|---|---|
| FR | 964503 | 4/1944 |
| GB | 442008 | 1/1936 |
| GB | 444484 | 3/1936 |
| GB | 651468 | 4/1951 |
| GB | 893869 | 4/1962 |
| GB | SU-750108 | 6/1975 |
| GB | SU-1448078 A1 | 3/1987 |
| GB | SU-1770570 A1 | 3/1990 |
| GB | 2 297 988 | 8/1996 |
| GB | 2 347 157 A | 8/2000 |
| RU | 876968 | 10/1981 |
| WO | 94/21889 | 9/1994 |
| WO | WO 94/21889 | 9/1994 |
| WO | WO 94/28280 | 12/1994 |
| WO | WO 97/21900 | 6/1997 |
| WO | WO 98/25005 | 6/1998 |
| WO | WO 99/60248 | 11/1999 |
| WO | 00/31376 | 6/2000 |
| WO | WO 00/79099 | 12/2000 |
| WO | WO 02/18738 | 3/2002 |
| WO | WO 02/059455 | 8/2002 |
| WO | WO 2004/035984 A1 | 4/2004 |
| WO | WO 2005003509 A1 | 1/2005 |

OTHER PUBLICATIONS

Notification of Transmittal of the International Search Report or the Declaration (PCT Rule 44.1) mailed Nov. 4, 2003 (7 pages) re International Application No. PCT/US 03/21628, filed Jul. 11, 2003.

Notification of Transmittal of the International Search Report or the Declaration (PCT Rule 44.1) mailed Dec. 5, 2003 (8 pages) re International Application No. PCT/US 03/21750, filed Jul. 11, 2003.

Examiner of Record, Office Action Response regarding the Interpretation of the three Russian Patent Applications listed above under Foreign Patent Documents (9 pages), date unknown.

B. Gotas et al., "*Performance of Openhole Completed and Cased Horizontal/Undulating Wells in Thin–Bedded, Tight Sand Gas Reservoirs*,"Society of Petroleum Engineers, Inc., Oct. 17 through Oct. 19, 2000, pp. 1–7.

R. Sharma, et al., "*Modelling of Undulating Wellbone Trajectories, The Journal of Canadian Petroleum Technology*", XP–002261908, Oct. 18–20, 1993, pp. 16–24.

E. F. Balbinski et al., "*Prediction of Offshore Viscous Oil Field Performance*," European Symposium on Improved Oil Recovery, Aug. 18–20, 1999, pp. 1–10.

Chi, Weiguo, "*A Feasible Discussion on Exploitation Coalbed Methane through Horizontal Network Drilling in China*", SPE 64709, Society of Petroleum Engineers (SPE International), 4 pages, Nov. 7, 2000.

Chi, Weiguo, "*Feasibility of Coalbed Methane Exploitation in China*", synopsis of paper SPE 64709, 1 page, Nov. 7, 2000.

Ian D. Palmer et al., "*Coalbed Methane Well Completions and Stimulations*", Chapter 14, pp. 303–339, Hydrocarbons from Coal, Published by the American Association of Petroleum Geologists, 1993.

Notification of Transmittal of the International Search Report or the Declaration (PCT Rule 44.1) mailed Dec. 19, 2003 (6 pages) re International Application No. PCT/US 03/28137, filed Sep. 9, 2003.

Notification of Transmittal of the International Search Report or the Declaration (PCT Rule 44.1) (3 pages) and International Search Report (7 pages) re International Application No. PCT/US 03/04771 mailed Jul. 4, 2003.

Notification of Transmittal of the International Search Report or the Declaration (PCT Rule 44.1) (3 pages) and International Search Report (5 pages) re International Application No. PCT/US 03/21891 mailed Nov. 13, 2003.

Notification of Transmittal of the International Search Report or the Declaration (PCT Rule 44.1) (3 pages) and International Search Report (4 pages) re International Application No. PCT/US 03/38383 mailed Jun. 2, 2004.

Kalinin, et al., Translation of Selected Pages from Ch. 4, Sections 4.2 (p. 135), 10.1 (p. 402), 10.4 (pp. 418–419), "*Drilling Inclined and Horizontal Well Bores*," Moscow, Nedra Publishers, 1997, 4 pages.

Jet Lavanway Exploration, "*Well Survey*," Key Energy Surveys, Nov. 2, 1997, 3 pages.

Precision Drilling, "*We Have Roots in Coal Bed Methane Drilling*," Technology Services Group, Published on or before Aug. 5, 2002, 1 page.

U.S. Dept. of Energy, "*New Breed of CBM/CMM Recovery Technology*, " Jul. 2003, 1 page.

Ghiselin, Dick, "*Unconventional Vision Frees Gas Reserves*," Natural Gas Quarterly, Sep. 2003, 2 pages.

CBM Review, World Coal, "*US Drilling into Asia*," Jun. 2003, 4 pages.
Skrebowski, Chris, "*US Interest in North Korean Reserves*," Petroleum, Energy Institute, Jul. 2003, 4 pages.
Zupanick, et al., U.S. Patent Application entitled "Method and System for Underground Treatment of Materials," U.S. Appl. No. 10/142,817, May 8, 2002 (WO 03/095795 A1) (55 pages).
Diamond et al., U.S. Patent Application entitled "Method and System for Removing Fluid From a Subterranean Zone Using an Enlarged Cavity," U.S. Appl. No. 10/264,535, Oct. 3, 2002 (37 pages).
Zupanick, U.S. Patent Application entitled "Method of Drilling Lateral Wellbores From a Slant Well Without Utilizing a Whipstock," U.S. Appl. No. 10/267,426, Oct. 8, 2002 (24 pages).
Rial et al., U.S. Patent Application entitled "Method and System for Controlling the Production Rate Of Fluid From A Subterranean Zone To Maintain Production Bore Stability In The Zone," U.S. Appl. No. 10/328,408, Dec. 23, 2002 (29 pages).
Zupanick, et al., U.S. Patent Application entitled "Method and System for Recirculating Fluid in a Well System," U.S. Appl. No. 10/457,103, Jun. 5, 2003 (41 pages).
Zupanick, U.S. Patent Application entitled "Method and System for Accessing Subterranean Deposits from the Surface and Tools Therefor," U.S. Appl. No. 10/630,345, Jul. 29, 2003 (366 pages).
Pauley, Steven, U.S. Patent Application entitled "Multi–Purpose Well Bores and Method for Accessing a Subterranean Zone From the Surface," U.S. Appl. No. 10/715,300, Nov. 17, 2003 (34 pages).
Seams, Douglas, U.S. Patent Application entitled "Method and System for Extraction of Resources from a Subterranean Well Bore," U.S. Appl. No. 10/723,322, Nov. 26, 2003 (40 pages).
Zupanick, U.S. Patent Application entitled "Slant Entry Well System and Method," U.S. Appl. No. 10/749,884, Dec. 31, 2003 (28 pages).
Zunpanick, U.S. Patent Application entitled "Method and System for Accessing Subterranean Deposits from the Surface," U.S. Appl. No. 10//761,629, Jan. 20, 2004 (38 pages).
Zupanick, U.S. Patent Application entitled "Method and System for Testing A Partially Formed Hydrocarbon Well for Evaluation and Well Planning Refinement," U.S. Appl. No. 10/769,221, Jan. 30, 2004 (34 pages).
Platt, "Method and System for Lining Multilateral Wells," U.S. Appl. No. 10/772,841, Feb. 5, 2004 (30 pages).
Zupanick, "System And Method For Directional Drilling Utilizing Clutch Assembly," U.S. Appl. No. 10/811,118, Mar. 25, 2004 (35 pages).
Zupanick et al., "Slot Cavity," U.S. Appl. No. 10/419,529, Apr. 21, 2003 (44 pages).
Zupanick, "System and Method for Multiple Wells from a Common Surface Location," U.S. Appl. No. 10/788,694, Feb. 27, 2004 (26 pages).
Field, T.W., "*Surface to In–seam Drilling—The Australian Experience*," Undated, 10 pages.
Drawings included in CBM well permit issued to CNX stamped Apr. 15, 2004 by the West Virgina Department of Environmenal Protection (5 pages).
Website of Mitchell Drilling Contractors, "*Services: Dymaxion—Surface to In–seam*," http://www.mitchell drilling-.com/dymaxion.htm, printed as of Jun. 17, 2004, 4 pages.
Website of CH4, "About Natural Gas—Technology," http://www.ch4.com.au/ng_technology.html, copyright 2003, printed as of Jun. 17, 2004, 4 pages.
Thomson, et al., "*The Application of Medium Radius Directional Drilling for Coal Bed Methane Extraction*," Lucas Technical Paper, copyrighted 2003, 11 pages.
U.S. Department of Energy, DE–FC26–01NT41148, "*Enhanced Coal Bed Methane Production and Sequestration of CO2 in Unmineable Coal Seams*" for Consol, Inc., accepted Oct. 1, 2001, 48 pages.
U.S. Department of Energy, "*Slant Hole Drilling*," Mar. 1999, 1 page.
Desai, Praful, et al., "*Innovative Design Allows Construction of Level 3 of Level 4 Junction Using the Same Platform*, "SPE/Petroleum Society of CIM/CHOA 78965, Canadian Heavy Oil Association, 2002, pp. 1–11.
Bybee, Karen, "*Advanced Openhole Multilaterals*," Horizontal Wells, Nov. 2002, pp. 41–42.
Bybee, Karen, "*A New Generation Multilateral System for the Troll Olje Field*," Multilateral/Extended Reach, Jul. 2002, 2 pages.
Emerson,, A.B., et al., "*Moving Toward Simpler, Highly Functional Multilateral Completions*," Technical Note, Journal of Canadian Petroleum Technology, May 2002, vol. 41, No. 5, pp. 9–12.
Moritis, Guntis, "*Complex Well Geometries Boost Orinoco Heavy Oil Producing Rates*," XP–000969491, Oil & Gas Journal, Feb. 28, 2000, pp. 42–46.
Themig, Dan, "*Multilateral Thinking*," New Technology Magazine, Dec. 1999, pp. 24–25.
Smith, R.C., et al., "*The Lateral Tie–Back System: The Ability to Drill and Case Multiple Laterals*," IADC/SPE 27436, Society of Petroleum Engineers, 1994, pp. 55–64, plus Multilateral Services Profile (1 page) and Multilateral Services Specifications (1 page).
Notification of Transmittal of the International Search Report or the Declaration (PCT Rule 44.1) (3 pages) and International Search Report (4 pages) re International Application No. PCT/US 03/13954 mailed Sep. 1, 2003.
Logan, Terry L., "*Drilling Techniques for Coalbed Methane*," Hydrocarbons From Coal, Chapter 12, Copyright 1993, Title Page, Copyright Page, pp. 269–285.
Hanes, John, "*Outbursts in Leichhardt Colliery: Lessons Learned*," International Symposium–Cum–Workshop on Management and Control of High Gas Emissions and Outbursts in Underground Coal Mines, Wollongong, NSW, Australia, Mar. 20–24, 1995, Title page, pp. 445–449.
Williams, Ray, et al., "*Gas Reservoir Properties for Mine Gas Emission Assessment*," Bowen Basin Symposium 2000, pp. 325–333.
Brown, K., et al., "*New South Wales Coal Seam Methane Potential*," Petroleum Bulletin 2, Department of Mineral Resources, Discovery 2000, Mar. 1996, pp. i–viii, 1–96.
Fipke, S., et al., "*Economical Multilateral Well Technology for Canadian Heavy Oil*," Petroleum Society, Canadian Institute of Mining, Metallurgy & Petroleum, Paper 2002–100, to be presented in Calgary Alberta, Jun. 11–13, 2002, pp. 1–11.
PowerPoint Presentation entitled, "Horizontal Coalbed Methane Wells," by Bob Stayon, Computalog Drilling Services, date is believed to have been in 2002 (39 pages).
Denney, Dennis, "*Drilling Maximum–Reservoir–Contact Wells in the Shaybah Field*," SPE 85307, pp. 60, 62–63, Oct. 20, 2003.

McCray and Cole, "Oil Well Drilling and Technology," *University of Oklahoma Press*, pp 315–319, 1959.
Berger and Anderson, "Modern Petroleum;" *PennWell Books*, pp 106–108, 1978.
Howard L. Hartman, et al.; "SME Mining Engineering Handbook;" *Society for Mining, Metallurgy, and Exploration, Inc.*; pp 1949–1950, 2nd Edition, vol. 2, 1992.
Dave Hassan, Mike Chernichen, Earl Jensen, and Morley Frank; "Multi–lateral technique lowers drilling costs, provides environmental benefits", *Drilling Technology*, pp. 41–47, Oct. 1999.
Gopal Ramaswamy, "Production History Provides CBM Insights," *Oil & Gas Journal*, pp. 49, 50 and 52, Apr. 2, 2001.
Arfon H. Jones et al., A Review of the Physical and Mechanical Properties of Coal with Implications for Coal–Bed Methane Well Completion and Production, *Rocky Mountain Association of Geologist*, pp. 169–181, 1988.
Joseph C. Stevens, Horizontal Applications For Coal Bed Methane Recovery, *Strategic Research Institute*, pp. 1–10 (slides), Mar. 25, 2002.
Weiguo Chi and Luwu Yang, "Feasibility of Coalbed Methane Exploitation in China," *Horizontal Well Technology*, p. 74, Sep. 2001.
Nackerud Product Description, *Harvest Tool Compant,LLC*, 1 page, received Sep. 27, 2001.
Gopal Ramaswamy, "Advances Key For Coalbed Methane," *The American Oil & Gas Reporter*, pp. 71 & 73, Oct. 2001.
R.J. "Bob" Stayton, "Horizontal Wells Boost CBM Recovery", Special Report: Horizontal & Directional Drilling, *American Oil & Gas Reporter*, pp. 71–75, Aug. 2002.
U.S. Appl. No. 09/769,098, entitled "Method and System for Enhanced Access to a Subterranean Zone," filed Jan. 24, 2004, 65 pages. (067083.0118).
U.S. Appl. No. 09/774,996, entitled "Method and System for Accessing a Subterranean Zone From a Limited Surface Area," filed Jan. 30, 2001, 67 pages. (067083.0120).
U.S. Appl. No. 09/788,897, entitled "Method and System for Accessing Subterranean Deposits From The Surface," filed Feb. 20, 2001, 54 pages. (067083.0138).
U.S. Appl. No. 10/142,817, entitled "Method and System for Underground Treatment of Materials," filed May 8, 2002, 54 pages. (067083.0119), May 2, 2002.
U.S. Appl. No. 09/885,219, entitled "Method and System for Accessing Subterranean Deposits From The Surface," filed Jun. 20, 2001, 52 pages. (067083.0140).
U.S. Appl. No. 10/046,001, entitled "Method and System for Management of By–Products From Subterranean Zones," filed Oct. 19, 2001, 42 pages. (067083.0134).
U.S. Appl. No. 10/004,316, entitled "Slant Entry Well System and Method," filed Oct. 30, 2001, 35 pages. (067083.0162).
U.S. Appl. No. 10/123,561, entitled "Method and System for Accessing Subterranean Zones From a Limited Surface," filed Apr. 5, 2002, 49 pages. (067083.0193).
U.S. Appl. No. 10/123,556, entitled "Method and System for Accessing Subterranean Zones From a Limited Surface," filed Apr. 5, 2002, 49 pages. (067083.0194), Apr. 5, 2001.
U.S. Appl. No. 10/165,627, entitled "Method and System for Accessing Subterranean Deposits from the Suraface," filed Jun. 7, 2002, 26 pages. (067083.0184).
U.S. Appl. No. 10/165,625, entitled "Method and System for Accessing Subterranean Deposits from the Surface," filed Jun. 7, 2002, 26 pages. (067083.0185).
Pend Pat App, Joseph A. Zupanick, "*Method and System for Accessing a Subterranean Zone From a Limited Surface*, " U.S. Appl. No. 10/188,141 (067083.0201), Jul. 1, 2002.
Pend Pat App, Joseph A. Zupanick, "*Undulating Well Bore*," U.S. Appl. No. 10/194,366 (067083.0176), Jul. 12, 2002.
Pend Pat App, Joseph A. Zupanick, "*RampingWell Bores*," U.S. Appl. No. 10/194,367 (067083.0179), Jul. 12, 2002.
Pend Pat App, Joseph A. Zupanick, "*Wellbore Sealing System and Method*," U.S. Appl. No. 10/194,368 (067083.0188), Jul. 12, 2002.
Pend Pat App, Joseph A. Zupanick, "*Wellbore Plug System and Method*," U.S. Appl. No. 10/194,422 (067083.0189), Jul. 12, 2002.
Pend Pat App, Joseph A. Zupanick, "*System and Method for Subterranean Access*" U.S. Appl. No. 10/227,057 (0181), Aug. 22, 2002.
Pend Pat App, Joseph A. Zupanick, *Three–Dimensional Well System for Accessing Subterranean Zones* (0190), Sep. 12, 2002.
Susan Eaton, "Reversal of Fortune", New Technology Magazine, pp. 30–31, Sep. 2002.
James Mahony, "A Shadow of Things to Come", New Technology Magazine, pp. 28–29, Sep. 2002.
Documents Received from Third Party, Great Lakes Directional Drilling, Inc., (12 pages), received Sep. 12, 2002.
Robert W. Taylor and Richard Russell, Multilateral Technologies Increase Operatioal Efficiencies in Middle East, Oil & Gas Jouranl, pp. 76–80, Mar. 16, 1998.
Adam Pasiczynk, "Evolution Simplifies Multilateral Wells", Directional Drilling, pp. 53–55, Jun. 2000.
Steven S. Bell, "Multilateral System with Full Re–Entry Access Installed", World Oil, p. 29, Jun. 1996.
P. Jackson and S. Kershaw, Reducing Long Term Methane Emissions Resulting from Coal Mining, Energy Convers. Mgmt, vol. 37, nos 6–8, pp. 801–806, 1996.
Pascal Breant, "Des Puits Branches, Chez Total : les puits multi drains", Total Exploration Production, pp. 1–5, Jan. 1999.
Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.
Brunner, D. J. and Schwoebel, J. J., "Directional Drilling for Methane Drainage and Exploration in Advance of Mining," REI Drilling Directional Underground, World Coal, 1999, 10 pages.
Thakur, P. C. "A History of Coalbed Methane Drainage From United States Coal Mines," 2003 SME Annual Meeting, Feb. 24–26, Cincinnati, Ohio, 4 pages.
U.S. Climate Change Technology Program, "Technology Options for the Near and Long Term," 4.1.5 Advances in Coal Mine Methane Recovery Systems, pp. 162–164.
Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.
Gardes, Robert, "Multi–Seam Completion Technology," Natural Gas Quarterly, E&P, Jun. 2004, pp. 78–81.

Baiton, Nicholas, "Maximize Oil Production and Recovery," Vertizontal Brochure, received Oct. 2, 2002, 4 pages.

Dreiling, Tim, McClelland, M. L. and Bilyeu, Brad, "Horizontal & High Angle Air Drilling in the San Juan Basin, New Mexico," Dated on or about Mar. 6, 2003, pp. 1–11.

Fong, David K., Wong, Frank Y., and McIntyre, Frank J., "An unexpected Benefit of Horizontal Wells on Offset Vertical Well Productivity in Vertical Miscible Floods," Canadian SPE/CIM/CANMET Paper No. HWC94–09, paper to be presented Mar. 20–23, 1994, Calgary, Canada, 10 pages.

Fischer, Perry A., "What's Happening in Production," World Oil, Jun. 2001, p. 27.

Website of PTTC Network News vol. 7, 1st Quarter 2001, Table of Contents, http://www.pttc.org/../news/v7n1nn4.htm printed Apr. 25, 2003, 3 pages.

Cox, Richard J. W., "Testing Horizontal Wells While Drilling Underbalanced," Delft University of Technology, Aug. 1998, 68 pages.

McLennan, John, et al., "Underbalanced Drilling Manual," Gas Research Institute, Chicago, Illinois, GRI Reference No. GRI–97/0236, copyright 1997, 502 pages.

The Need for a Viable Mutli–Seam Completion Technology for the Powder River Basin, Current Practice and Limitations, Gardes Energy Services, Inc., Believed to be 2003 (8 pages).

Langley, Diane, "Potential Impact of Microholes Is Far From Diminutive," JPT Online, http://www.spe.org/spe/jpt/jps, Nov. 2004 (5 pages).

Consol Energy Slides, "Generating Solutions, Fueling Change," Presented at Appalachian E&P Forum, Harris Nesbitt Corp., Boston, Oct. 14, 2004 (29 pages).

Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Nov. 10, 2004.

Schenk, Christopher J., "Geologic Definition and Resources Assesment of Continous (Unconvention) Gas Accumulations –The U.S. Experience," Website, http://aapg.confex.com...//. printed Nov. 16, 2004 (1 page).

U.S. Department of Interior, U.S. Geological Survey, "Characteristics of Discrete and Basin–Centered Parts of the Lower Silurian Regional Oil and Gas Accumulation, Appalachian Basin: Preliminary Results From a Data Set of 25 oil and Gas Fields," U.S. Geological Survey Open–File Report 98–216, Website, http://pubs.usgs.gov/of/1998/of98–216/introl.htm, printed Nov. 16, 2004 (2 pages).

Zupanick, J., "Coalbed Methane Extraction," 28th Mineral Law Conference, Lexington, Kentucky, Oct. 16–17, 2003 (48 pages).

Zupanick, J., "CDX Gas –Pinnacle Project," Presentation at the 2002 Fall Meeting of North American Coal Bed Methane Forum, Morgantown, West Virginia, Oct. 30, 2002 (23 pages).

Lukas, Andrew, Lucas Drilling Pty Ltd., "Technical Innovation and Engineering Xstrata –Oaky Creek Coal Pty Limited," Presentation at Coal Seam Gas & Mine Methane Conference in Brisbane, Nov. 22–23, 2004 (51 pages).

Field, Tony, Mitchell Drilling, "Let'Get Technical –Drilling Breakthroughs in Surface to In–Seam in Australia," Presentation at Coal Seam Gas & Mine Methane Conference in Brisbane, Nov. 22–23, 2004 (20 pages).

Zupanick, Joseph A, "Coal Mine Methane Drainage Utilizing Multilateral Horizontal Wells," 2005 SME Annual Meeting & Exhibit, Feb. 28 –Mar. 2, 2005, Salt Lake City, Utah (6 pages).

The Official Newsletter of the Cooperative Research Centre for Mining Technology and Equipment, CMTE News 7, "Tight–Radius Drilling Clinches Award," Jun. 2001, 1 page.

Dreiling, Tim, McClelland, M. L. and Bilyeu, Brad, "Horizontal & High Angle Air Drilling in the San Juan Basin, New Mexico," Believed to be dated Apr. 1996, pp. 1–11.

Listing of 174 References received from Third Party on Feb. 16, 2005 (9 pages).

Gardes Directional Drilling, "Multiple Directional Wells From Single Borehole Developed," Reprinted from Jul. 1989 edition of Offshore, Corpyright 1989 edition of Offshore, Copyright 1989 by Penn Well Publishing Company (4 pages).

"Economic Justification and Modeling of Mutlilateral Wells," Economic Analysis, Hart's Petroleum Engineering International, 1997 (4 pages).

Mike Chambers, "Mutli–Lateral Completions at Mobil Past, Present, and Future," presented at the 1998 Summit on E&P Drilling Technologies, Strategic Research Institute, Aug. 18–19, 1998 in San Antonio, Texas (26 pages).

David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982 (56 pages).

P. Corlay, D. Bossie–Codreanu, J. C. Sabathier and E. R. Delamaide, "Improving Reservoir Management With Complex Well Architectures," Field Production & Reservoir Management, World Oil, Jan. 1997 (5 pages).

Eric R. Skonberg and Hugh W. O'Donnell, "Horizontal Drilling for Underground Coal Gasification," presented at the Eighth Underground Coal Conversion Symposium, Keystone, Colorado Aug. 16, 1982 (8 pages).

Gamal Ismail, A. S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).

Gamal Ismail, H. El–Khatib – Zadco, Abu Dhabi, UAE, "Multi–Lateral Horizontal Drilling Problems & Solutions Experienced Offshore Abu Dhabi," SPE 36252, Society of Petroleum Engineers, Oct. 1996 (12 pages).

C.M. Matthews and L.J. Dunn, "Drilling and Production Practices to Mitigate Sucker Rod/Tubing Wear–Related Failures in Directional Wells," SPE 22852, Society of Petroleum Engineers, Oct. 1991 (12 pages).

H.H. Fields, Stephens Krickovic, Albert Sainato, and M.G. Zabetakis, "Degasification of Virgin Pittsburgh Coalbed Through a Large Borehole," RI–7800, Bureau of Mines Report of Investigations/1973, United States Department of the Interior, 1973 (31 pages).

William P. Diamond, "Methane Control for Underground Coal Mines," IC–9395, Bureau of Mines Information Circular, United States Department of the Interior, 1994 (51 pages).

Technology Scene Drilling & Intervention Services, "Weatherford Moves Into Advanced Multiateral Well Completion Technology" and "Productivity Gains and Safety Record Speed Acceptance of UBS," *Reservoir Mechanics,* Weatherford International, Inc., 2000 Annual Report (2 pages).

"A Different Direction for CBM Wells," *W Magazine,* 2004 Third Quarter (5 pages).

Snyder, Robert E., "What's New in Production," *WorldOil Magazine,* Feb. 2005, [printed from the Internet on Feb. 7, 2005], http://www.worldoil.com/magazine/MAGAZINE_Detail.asp?ART ID=2507@ MONTH_YEAR (3 pages).

Nazzal, Greg, "Moving Multilateral Systems to the Next Level, Strategic Acquisition Expands Weatherford's Capabilities," 2000 (2 pages).

Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).

Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.

King, Robert F., "Drilling Sideways –A Review of Horizontal Well Technology and its Domestic Application," DOE/EIA–TR–0565, U.S. Department of Energy, Apr. 1993, 30 pages.

Santos, Helio, Impact Engineering Sloutions and Jesus Olaya, Ecopetrol/ICP, "*No–Damage Drilling: How to Acheive this Challenging?, "* SPE 77189, Copyright 2002, presented at the IADC/SPE Asia Pacific Drilling Technology, Jakarta, Indonesia, 10/20–23/2002, 10 pages.

Franck Labenski, Paul Reid, SPE, and Helio Santos, SPE, Impact Solutions Group, "*Drilling Fluids Approaches for Control of Wellbore Instability in Fractured Formations,"* SPE/IADC 85304, Society of Petroleum Engineers, Copyright 2003, presented at the SPE/IADC Middle East Drilling Technology Conference & Exhibition in Abu Chabi, UAE, 10/20–22/2003, 8 pages.

P. Reid, SPE, and H. Santos, SPE, Impact Solutions Group, "*Novel Drilling, Completion and Workover Fluids for Depleted Zones: Avoiding Losses, Formation Damage and Stuck Pipe,"* SPe/IADC 85326, Society of Petroleum Engineers, Copyright 203, presented at the SPE/IADC Middle East Drilling Conference & Exhibtion in Abu Chabi, UAE, 10/20–22/2003, 9 pages.

Craig C. White and Adrian P. Chesters, NAM; Catalin D. Ivan, Sven Maikranz and Rob Nouris, M–I L.L.C., "*Aphron–based drilling fluid: Novel technology for drilling depleted formations,"* WORLD OIL, Drilling Report Special Focus, Oct. 2003, 5 pages.

Robert E. Synder, "Drilling Advances," WORLD OIL, Oct. 2003, 1 page.

U.S. Environmental Protection Agency, "Directional Drilling Technology," prepared for the EPA by Advanced Resources International under Contract 68–W–00–094, Coalbed Methane Outreach Program (CMOP), Website: http://search.epa.gov/search.epa.gov/s97is.vts, printed Mar. 17, 2005, 13 pages.

"Meridian Tests New Technology," Western Oil World, Jun. 1990, Cover, Table of Contents and p. 13.

Clint Leazer and Michael R. Marquez, "Short–Radius Drilling Expands Horizontal Well Applications," Petroleum Engineer International, Apr. 1995, 6 pages.

Terry R. Logan, "Horizontal Drainhole Drilling Techniques Used in Rocky Mountains Coal Seams," Geology and Coal–Bed Methane Resources of the Nothern San Juan Basin, Colorado and New Mexico, Rocky Mountain Association of Geologists, Coal–Bed Methane, San Juan Basin, 1988, pp. cover, 133–142.

Daniel J. Brunner, Jeffery J. Schwoebel, and Scott Thomson, "Directional Drilling for Methane Drainage & Exploration in Advance of Mining," Website: http://www.advminingtech.com.au/Paper4.htm, printed Apr. 6, 2005, Copyright 1999, Last modified Aug. 7, 2002 (8 pages).

Karen Bybee, highlights of paper SPE 84424, "Coalbed–Methane Reservoir Simulation: An Evolving Science," by T.L. Hower, JPT Online, Apr. 2004, Website; http://www.spe.org/spe/jpt/jsp/jptppapersynopsis/0.2439, 1104_11038_2354946_2395832.00.html, printed Apr. 14, 2005, 4 pages.

Kevin Meaney and Lincoln Paterson, "Relative Permeability in Coal," SPE 36986, Society of Petroleum Engineers, Copyright 1996, pp. 231–236.

Calender of Events – Conference Agenda, Fifth Annual Unconventional Gas and Coalbed Methane Conference, Oct. 22–24, 2003, in Calgary Alberta, Website: http://www.csug.ca/cal/calc0301a.html, printed Mar. 17, 2005, 5 pages .

Tom Engler and Kent Perry, "Creating a Roadmap for Unconventional Gas R&D," Gas TIPS, Fall 2002, pp. 16–20.

CSIRO Petroleum – SIMEDWin, "Summary of SIMEDWin Capabilites," Copyright 1997–2005, Website: http://www.dpr.csiro.au/ourcapabilities/petroleumgeoengineering/reservoirengineergineering/projects/sime/dwin/assets/simed/index.html, printed Mar. 17, 2005, 10 pages.

Solutions From the Field, "Coalbed Methane Resources in the Sothwest," Copyright 2004, Website: http://www.pttc.org/solutions/sol¯2004/537.htm, printed Mar. 17, 2005, 7 pages.

Jeffery R. Levine, Ph.D., "Matrix Shrinkage Coefficient," Undated, 3 pages.

G. Twonbly, S.H. Stepanek, T.A. Moore, Coalbed Methane Potential in the Waikato Coalfield of New Zealand: A Comparsion With Devloped Basins in the United States , 2004 New Zealand Petroleum Conference Proceedings, Mar. 7–10, Mar. 7–10, 2004, pp. 1–6.

R.W. Cade, "Horizontal Wells: Development and Applications," Presented at the Fifth International Symposium on Geophysics for Mineral, Geotechnical and Environmental Applications, Oct. 24–28, 1993 in Tulsa, Oklahoma, Website: http:www..mgls.org/93Sym/Cade/cade.html, printed Mar. 17, 2005, 6 pages.

Solutions From the Field, "Horizontal Drilling, A Technology Update for the Appalachian Basin," Copyright 2004, Website: http://www.pttc.org/solutions/sol_2004/535.htm, printed Mar. 17, 2005, 6 pages.

R. Purl, J.C. Evanoff and M.L. Brugler, "Measurement of Coal Cleat Porosity and Relative Permeability Characteristics," SPE 21491, Society of Petroleum Engineers, Copyright 1991, pp. 93–104.

Peter Jackson, "Drilling Technologies for Underground Coal Gasification," IMC Geophysics Ltd., International UCG Workshop – Oct. 2003 (20 pages).

Notification of Transmittal of the International Search Report and the Written Opinion of the International Searching Authority, or the Declaration (3 pages), International Search Report (3 pages) and Written Opinion of the International Searching Authority (5 pages) re Interantional Application No. PCT/US2005/002162 mailed Apr. 22, 2005.

Notification of Transmittal of the International Search Report and the Written Opinion of the International Searching Authority, of the International Searching Authority (5 pages0 re International Application No. PCT/US2005/005289 mailed Apr. 29, 2005.

Notification of Transmittal of the International Search Report and the Written Opinion of the International Searching Authority, or the Declaration (3 pages), International Search Report (5 pages) and Written Opinion of the International Searching Authority (5 pages) re International Application No. PCT/US2004/036616 mailed Feb. 24, 2005.

Notification of Transmittal of International Preliminary Examination Report (1 page) and International Preliminary Examination Report (3 pages) for International Application No. PCT/US03/13954 Apr. 14, 2005.

Notification of Transmittal of International Preliminary Examination Report (1 page) and International Preliminary Examination Report (5 pages) mailed Jan. 18, 2005 and Written Opinion (8 pages) mailed Aug. 25, 2005 for International Application No. PCT/US03/30126.

Notification of Transmittal of the International Search Report or the Declaration (3 pages) and International Search Report (5 pages) mailed Nov. 10, 2000 for International Application No. PCT/US99/27494.

Notification of Transmittal of International Preliminary Examination Report (1 page) and International Preliminary Examination Report (6 pages) mailed Apr. 2, 2001 and Written Opinion mailed Sep. 27, 2000 for International Application No. PCT/US99/27494.

Notification of Transmittal of the International Search Report or the Declaration (3 pages) and International Search Report (5 pages) mailed Jun. 6, 2002 for International Application No. PCT/US02/02051.

Notification of Transmittal of the International Search Report or the Declaration (3 pages) and International Search Report (6 pages) mailed Mar. 13, 2003 for International Application No. PC/US02/33128.

Notification of Transmittal of International Preliminary Examination Report (1 page) and International Preliminary Examination Report (3 page mailed Apr. 22, 2004 and Written Opinion mailed Sep. 4, 2003 for International Application No. PCT/US02/33128.

Notes on Consol Presentation (by P. Thakur) made at IOGA PA in Pittsburgh, Pennsylvania on May 22, 2002 (3 pages).

* cited by examiner

METHOD AND SYSTEM FOR CONTROLLING PRESSURE IN A DUAL WELL SYSTEM

TECHNICAL FIELD OF THE INVENTION

The present invention relates generally to systems and methods for the recovery of subterranean resources and, more particularly, to a method and system for controlling pressure in a dual well system.

BACKGROUND OF THE INVENTION

Subterranean deposits of coal, also referred to as coal seams, contain substantial quantities of entrained methane gas. Production and use of methane gas from coal deposits has occurred for many years. Substantial obstacles, however, have frustrated more extensive development and use of methane gas deposits in coal seams.

For example, one problem of surface production of gas from coal seams may be the difficulty presented at times by over-balanced drilling conditions caused by the porosity of the coal seam. During both vertical and horizontal surface drilling operations, drilling fluid is used to remove cuttings from the well bore to the surface. The drilling fluid exerts a hydrostatic pressure on the formation which, if it exceeds the pressure of the formation, can result in a loss of drilling fluid into the formation. This results in entrainment of drilling fines in the formation, which tends to plug the pores, cracks, and fractures that are needed to produce the gas. Other problems include a difficulty in maintaining a desired pressure condition in the well system during drill string tripping and connection operations.

SUMMARY OF THE INVENTION

The present invention provides a method and system for controlling pressure in a dual well system that substantially eliminates or reduces at least some of the disadvantages and problems associated with controlling pressure in previous well systems.

In accordance with a particular embodiment of the present invention, a method for controlling pressure of a dual well system includes drilling a substantially vertical well bore from a surface to a subterranean zone and drilling an articulated well bore from the surface to the subterranean zone using a drill string. The articulated well bore is horizontally offset from the substantially vertical well bore at the surface and intersects the substantially vertical well bore at a junction proximate the subterranean zone. The method includes drilling a drainage bore from the junction into the subterranean zone. The method includes pumping a drilling fluid through the drill string when drilling the drainage bore. The drilling fluid exits the drill string proximate a drill bit of the drill string. The method includes pumping a pressure fluid down the substantially vertical well bore when drilling the drainage bore. The pressure fluid mixes with the drilling fluid to form a fluid mixture returning up the articulated well bore. The fluid mixture returning up the articulated well bore forms a frictional pressure that resists fluid flow from the subterranean zone.

In accordance with another embodiment, a dual well system for controlling pressure in the wells includes a substantially vertical well bore extending from a surface to a subterranean zone and an articulated well bore extending from the surface to the subterranean zone. The articulated well bore is horizontally offset from the substantially vertical well bore at the surface and intersects the substantially vertical well bore at a junction proximate the subterranean zone. A drainage bore extends from the junction into the subterranean zone. A drill string disposed within the articulated well bore is used to drill the drainage bore. A drilling fluid is provided through the drill string and exits the drill string proximate a drill bit of the drill string. A pressure fluid is provided down the substantially vertical well bore. The pressure fluid mixes with the drilling fluid to form a fluid mixture returning up the articulated well bore. The fluid mixture returning up the articulated well bore forms a frictional pressure that resists fluid flow from the subterranean zone.

Technical advantages of particular embodiments of the present invention include a method of controlling pressure in a well system beyond that of conventional hydrostatically controlled technology. Frictional pressure is used to provide the desired drilling conditions in the system. The pressure in an articulated well bore may be varied in real time, as needed or desired, by varying the frictional pressure caused by fluid flow in the well system. The frictional pressure may be varied by changing pump speeds and by changing the composition of fluids pumped through the system by adding, for example, compressed gas to the fluids.

Other technical advantages will be readily apparent to one skilled in the art from the figures, descriptions and claims included herein. Moreover, while specific advantages have been enumerated above, various embodiments may include all, some or none of the enumerated advantages.

BRIEF DESCRIPTION OF THE DRAWINGS

For a more complete understanding of particular embodiments of the invention and their advantages, reference is now made to the following descriptions, taken in conjunction with the accompanying drawings, in which.

DETAILED DESCRIPTION OF THE INVENTION

Figure 1:
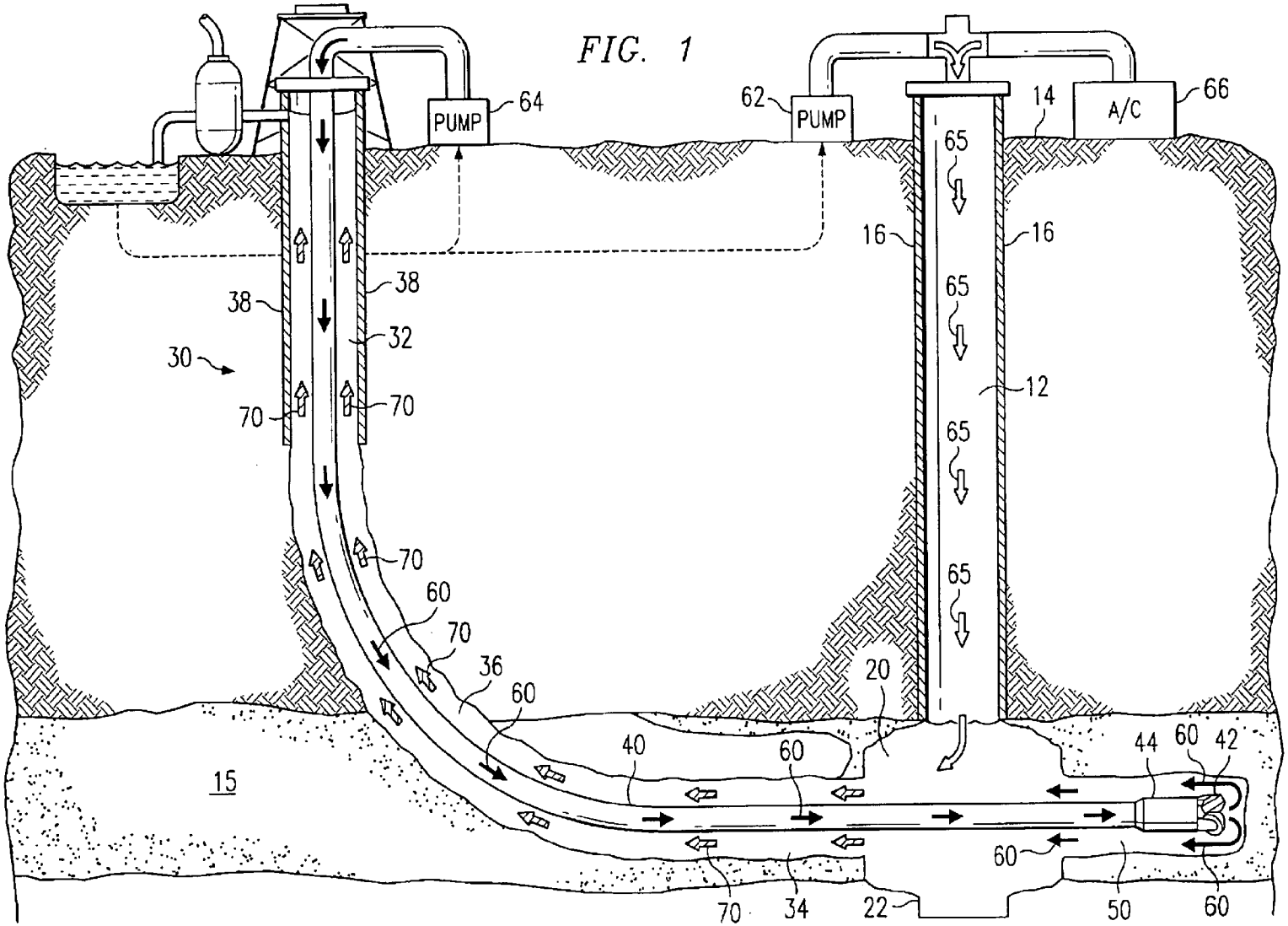
FIG. 1 illustrates an example system for controlling pressure in a dual well drilling operation in which a pressure fluid is pumped down a substantially vertical well bore in accordance with an embodiment of the present invention.

FIG. 1 illustrates an example dual well system for accessing a subterranean zone from the surface. In one embodiment, the subterranean zone may comprise a coal seam. It will be understood that other subterranean zones, such as oil or gas reservoirs, can be similarly accessed using the dual well system of the present invention to remove and/or produce water, hydrocarbons and other fluids in the subterranean zone and to treat minerals in the subterranean zone prior to mining operations.

Referring to FIG. 1, a substantially vertical well bore 12 extends from a surface 14 to a target layer subterranean zone 15. Substantially vertical well bore 12 intersects and penetrates subterranean zone 15. Substantially vertical well bore 12 may be lined with a suitable well casing 16 that terminates at or above the level of the coal seam or other subterranean zone 15.

Substantially vertical well bore 12 may be logged either during or after drilling in order to locate the exact vertical depth of the target subterranean zone 15. As a result, subterranean zone 15 is not missed in subsequent drilling operations, and techniques used to locate zone 15 while drilling need not be employed. An enlarged cavity 20 may be formed in substantially vertical well bore 12 at the level of subterranean zone 15. Enlarged cavity 20 may have a different shape in different embodiments. For example, in particular embodiments enlarged cavity 20 may have a generally cylindrical shape or a substantially non-circular shape. Enlarged cavity 20 provides a junction for intersection of substantially vertical well bore 12 by an articulated well bore used to form a drainage bore in subterranean zone 15. Enlarged cavity 20 also provides a collection point for fluids drained from subterranean zone 15 during production operations. Enlarged cavity 20 is formed using suitable underreaming techniques and equipment. A vertical portion of substantially vertical well bore 12 continues below enlarged cavity 20 to form a sump 22 for enlarged cavity 20.

An articulated well bore 30 extends from the surface 14 to enlarged cavity 20 of substantially vertical well bore 12. Articulated well bore 30 includes a substantially vertical portion 32, a substantially horizontal portion 34, and a curved or radiused portion 36 interconnecting vertical and horizontal portions 32 and 34. Horizontal portion 34 lies substantially in the horizontal plane of subterranean zone 15 and intersects enlarged cavity 20 of substantially vertical well bore 12. In particular embodiments, articulated well bore 30 may not include a horizontal portion, for example, if subterranean zone 15 is not horizontal. In such cases, articulated well bore 30 may include a portion substantially in the same plane as subterranean zone 15.

Articulated well bore 30 is offset a sufficient distance from substantially vertical well bore 12 at surface 14 to permit curved portion 36 and any desired horizontal portion 34 to be drilled before intersecting enlarged cavity 20. In one embodiment, to provide curved portion 36 with a radius of 100–150 feet, articulated well bore 30 is offset a distance of about 300 feet from substantially vertical well bore 12. As a result, reach of the articulated drill string drilled through articulated well bore 30 is maximized.

Articulated well bore 30 may be drilled using an articulated drill string 40 that includes a suitable down-hole motor and drill bit 42. A measurement while drilling (MWD) device 44 may be included in articulated drill string 40 for controlling the orientation and direction of the well bore drilled by the motor and drill bit 42. The substantially vertical portion 32 of the articulated well bore 30 may be lined with a suitable casing 38.

After enlarged cavity 20 has been successfully intersected by articulated well bore 30, drilling is continued through enlarged cavity 20 using articulated drill string 40 and appropriate horizontal drilling apparatus to drill a drainage bore 50 in subterranean zone 15. Drainage bore 50 and other such well bores include sloped, undulating, or other inclinations of the coal seam or subterranean zone 15. During this operation, gamma ray or acoustic logging tools and other MWD devices may be employed to control and direct the orientation of the drill bit to retain the drainage bore 50 within the confines of subterranean zone 15 and to provide substantially uniform coverage of a desired area within the subterranean zone 15.

During the process of drilling drainage bore 50, drilling fluid (such as drilling "mud") is pumped down articulated drill string 40 using pump 64 and circulated out of articulated drill string 40 in the vicinity of drill bit 42, where it is used to scour the formation and to remove formation cuttings. The drilling fluid is also used to power drill bit 42 in cutting the formation. The general flow of the drilling fluid through and out of drill string 40 is indicated by arrows 60.

Foam, which in certain embodiments may include compressed air mixed with water, may be circulated down through articulated drill string 40 with the drilling mud in order to aerate the drilling fluid in articulated drill string 40 and articulated well bore 30 as articulated well bore 30 is being drilled and, if desired, as drainage bore 50 is being drilled. Drilling of drainage bore 50 with the use of an air hammer bit or an air-powered down-hole motor will also supply compressed air or foam to the drilling fluid. In this case, the compressed air or foam which is used to power the drill bit or down-hole motor exits the vicinity of drill bit 42.

A pressure fluid may be pumped down substantially vertical well bore 12 using pump 62 as indicated by arrows 65. The pressure fluid pumped down substantially vertical well bore 12 may comprise nitrogen gas, water, air, drilling mud or any other suitable materials. The pressure fluid enters enlarged cavity 20 where the fluid mixes with the drilling fluid which has been pumped through articulated drill string 40 and has exited articulated drill string 40 proximate drill bit 42. The mixture of the pressure fluid pumped down substantially vertical well bore 12 and the drilling fluids pumped through articulated drill string 40 (the "fluid mixture") flows up articulated well bore 30 in the annulus between articulated drill string 40 and the surface of articulated well bore 30. Such flow of the fluid mixture is generally represented by arrows 70 of FIG. 1. The flow of the fluid up articulated well bore 30 creates a frictional pressure in the well bore system. The frictional pressure and the hydrostatic pressure in the well bore system resist fluids from subterranean zone 15 ("subterranean zone fluid"), such as water or methane gas contained in subterranean zone 15, from flowing out of subterranean zone 15 and up articulated well bore 30. The frictional pressure may also maintain the bottom hole equivalent circulating pressure of the well system.

In this embodiment, pumps 62 and 64 pump the drilling fluid and the pressure fluid into the system; however, in other embodiments other suitable means or techniques may be used to provide the drilling fluid and the pressure fluid into the system.

When the hydrostatic and frictional pressure in articulated well bore 30 is greater than the formation pressure of subterranean zone 15, the well system is considered over-balanced. When the hydrostatic and frictional pressure in articulated well bore 30 is less than the formation pressure of subterranean zone 15, the well system is considered under-balanced. In an over-balanced drilling situation, drilling fluid and entrained cuttings may be lost into subterranean zone 15. Loss of drilling fluid and cuttings into the formation is not only expensive in terms of the lost drilling fluids, which must be made up, but it tends to plug the pores in the subterranean zone, which are needed to drain the zone of gas and water.

In particular embodiments, the pressure fluid pumped down substantially vertical well bore 12 may include compressed gas provided by an air compressor 66. Using compressed gas within the fluid pumped down vertical well bore 12 will lighten the pressure of the pressure fluid thus lightening the frictional pressure of the fluid mixture flowing up articulated well bore 30. Thus, the composition of the pressure fluid (including the amount of compressed gas or other fluids making up the pressure fluid) may be varied in order to vary or control the frictional pressure resulting from the flow of the fluid mixture up articulated well bore 30. For example, the amount of compressed gas pumped down vertical well bore 12 may be varied to yield over-balanced, balanced or under-balanced drilling conditions. Another way to vary the frictional pressure in articulated well bore 30 is to vary flow rate of the pressure fluid by varying the speeds of pumps 62 and 64. The frictional pressure may be changed in real time and very quickly, as desired, using the methods described herein.

The frictional pressure may be varied for any of a variety of reasons, such as during a blow out from the pressure of fluids in subterranean zone 15. For example, drill bit 42 may hit a pocket of high-pressured gas in subterranean zone 15 during drilling. At this point the speed of pump 62 may be increased so as to maintain a desired relationship between the frictional pressure in articulated well bore 30 and the increased formation pressure from the pocket of high-pressured gas. By varying the frictional pressure, low pressure coal seams and other subterranean zones can also be drilled without substantial loss of drilling fluid and contamination of the zone by the drilling fluid.

Fluid may also be pumped down substantially vertical well bore 12 by pump 62 while making connections to articulated drill string 40, while tripping the drill string or in other situations when active drilling is stopped. Since drilling fluid is typically not pumped through articulated drill string 40 during drill string connecting or tripping, one may increase the pumping rate of fluid pumped down substantially vertical well bore 12 by a certain volume to make up for the loss of drilling fluid flow through articulated drill string 40. For example, when articulated drill string 40 is removed from articulated well bore 30, pressure fluid may be pumped down vertical well bore 12 and circulated up articulated well bore 30 between articulated drill string 40 and the surface of articulated well bore 30. This fluid may provide enough frictional and hydrostatic pressure to prevent fluids from subterranean zone 15 from flowing up articulated well bore 30. Pumping an additional amount of fluid down substantially vertical well bore 12 during these operations enables one to maintain a desired pressure condition on the system when not actively drilling.

Figure 2:
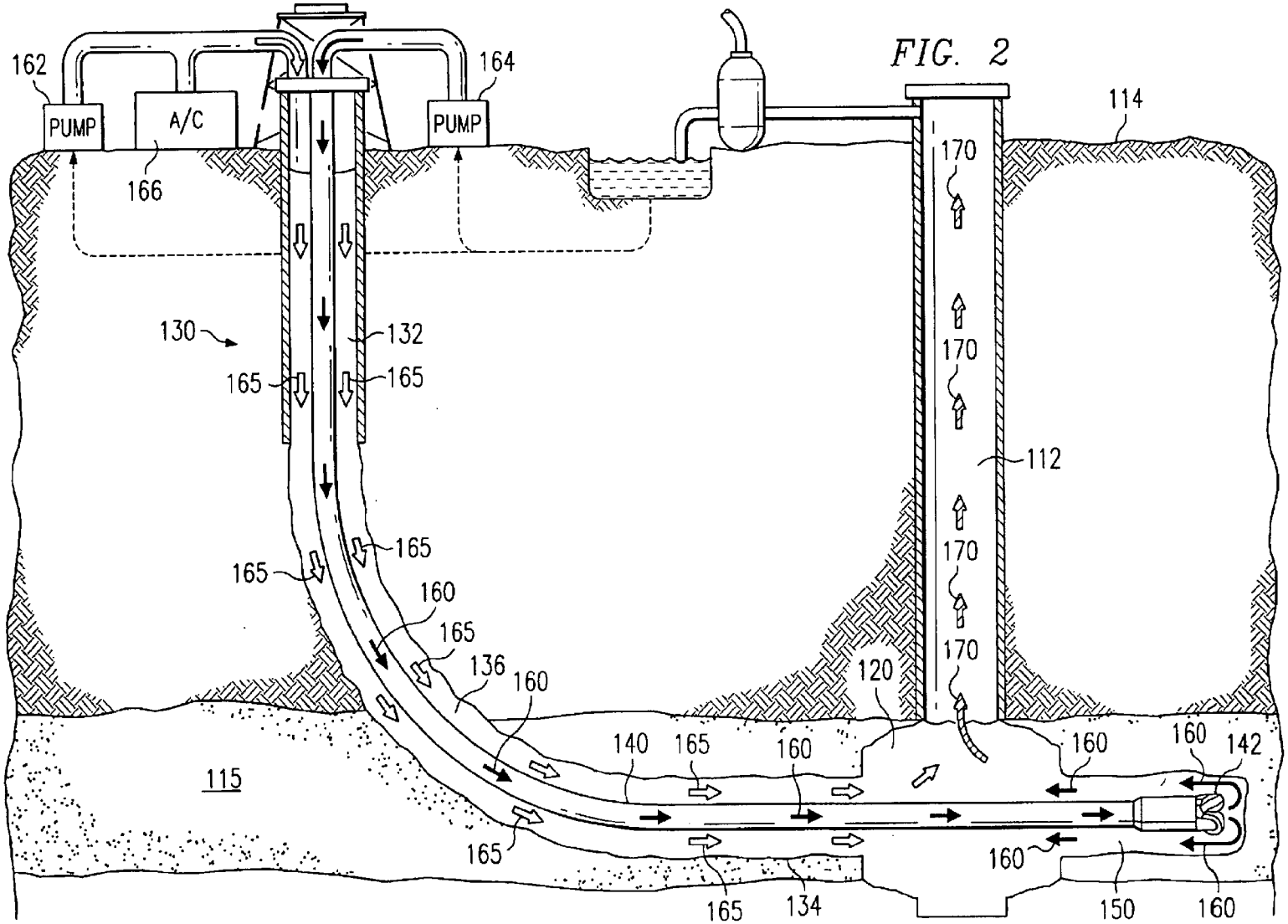
FIG. 2 illustrates an example system for controlling pressure in a dual well drilling operation in which a pressure fluid is pumped down an articulated well bore in accordance with another embodiment of the present invention.

FIG. 2 illustrates an example dual well system for accessing a subterranean zone from the surface 114. The system includes a substantially vertical well bore 112 and an articulated well bore 130. Articulated well bore 130 includes a substantially vertical portion 132, a curved portion 136 and a substantially horizontal portion 134. Articulated well bore 130 intersects an enlarged cavity 120 of substantially vertical well bore 112. Substantially horizontal portion 134 of articulated well bore 130 is drilled through subterranean zone 115. Articulated well bore 130 is drilled using an articulated drill string 140 which includes a down-hole motor and a drill bit 142. A drainage bore 150 is drilled using articulated drill string 140.

The dual well system of FIG. 2 is similar in operation to dual well system of FIG. 1. However, in the dual well system of FIG. 2, the pressure fluid is pumped down articulated well bore 130 in the annulus between articulated drill string 140 and the surface of articulated well bore 130 using pump 162. The general flow of this pressure fluid is represented on FIG. 2 by arrows 165. Drilling fluid is pumped down articulated drill string 140 during drilling of drainage bore 150 using pump 164 as described in FIG. 1. Drilling fluid drives drill bit 142 and exits articulated drill string 140 proximate drill bit 142. The general flow of the drilling fluid through and out of articulated drill string 140 is represented by arrows 160.

After the drilling fluid exits articulated drill string 140, it generally flows back through drainage bore 150 and mixes with the pressure fluid which has been pumped down articulated well bore 130. The resulting fluid mixture flows up substantially vertical well bore 112. The general flow of the resulting fluid mixture is represented by arrows 170. The flow of the pressure fluid down articulated well bore 130 and fluid mixture up substantially vertical well bore 112 creates a frictional pressure in dual well system 110. This frictional pressure, combined with the hydrostatic pressure from the fluids, provides a resistance to formation fluids from subterranean zone 115 from leaving the subterranean zone. The amount of frictional pressure provided may be varied to yield over-balanced, balanced or under-balanced drilling conditions.

The pressure fluid pumped down articulated well bore 130 may include compressed gas provided by air compressor 166. Compressed gas may be used to vary the frictional pressure discussed above provided in the system. The speed of pumps 162 and 164 may also be varied to control the pressure in the system, for example, when a pocket of high-pressured gas is encountered in subterranean zone 115. An additional amount of pressure fluid may be pumped down articulated well bore 130 during connections of articulated drill string 140, tripping, other operations or when drilling is otherwise stopped in order to maintain a certain frictional pressure on subterranean zone 115.

Figure 3:
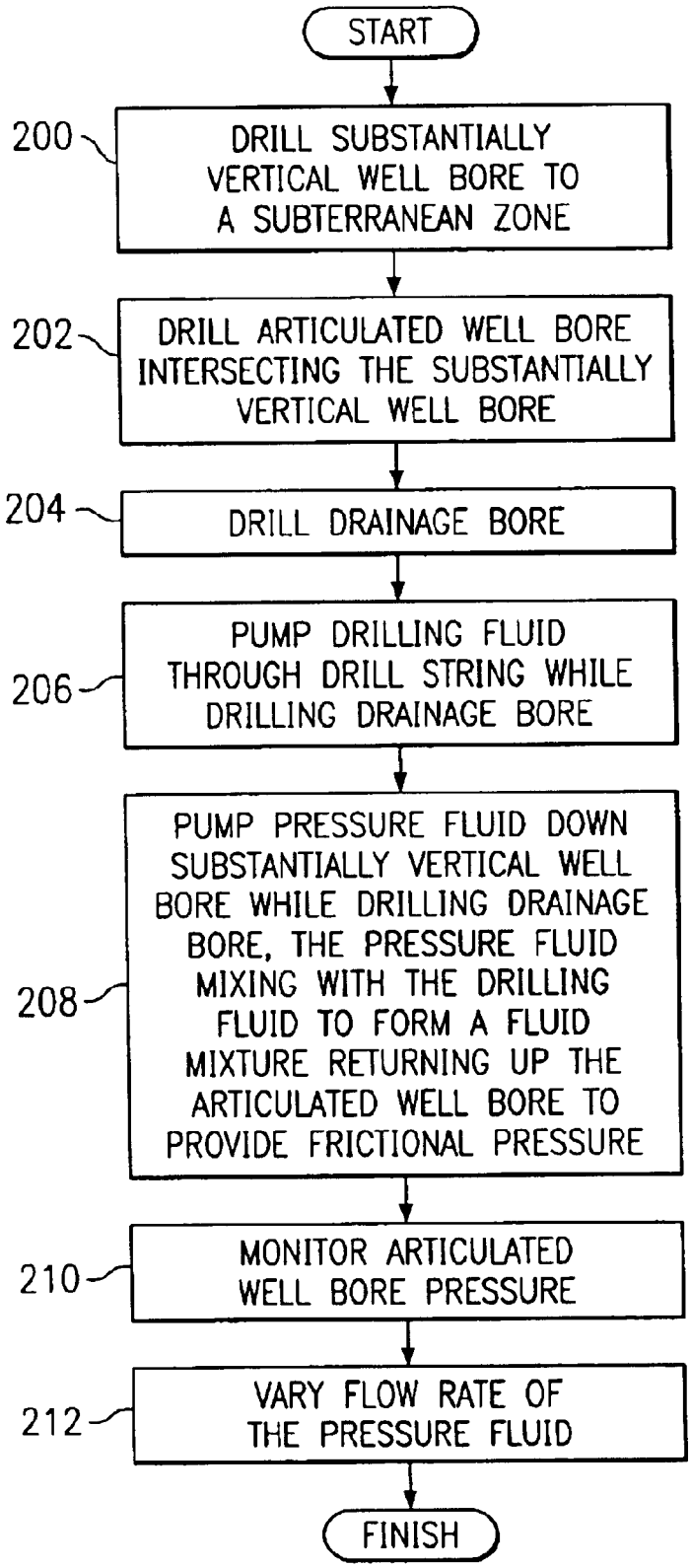
FIG. 3 is a flow chart illustrating an example method for controlling pressure of a dual well system in accordance with an embodiment of the present invention.

FIG. 3 is a flowchart illustrating an example method for controlling pressure of a dual well system in accordance with an embodiment of the present invention. The method begins at step 200 where a substantially vertical well bore is drilled from a surface to a subterranean zone. In particular embodiments, the subterranean zone may comprise a coal seam, a gas reservoir or an oil reservoir. At step 202 an articulated well bore is drilled from the surface to the subterranean zone. The articulated well bore is drilled using a drill string. The articulated well bore is horizontally offset from the substantially vertical well bore at the surface and intersects the substantially vertical well bore at a junction proximate the subterranean zone.

Step 204 includes drilling a drainage bore from the junction into the subterranean zone. At step 206, a drilling fluid is pumped through the drill string when the drainage bore is being drilled. The drilling fluid may exit the drill string proximate a drill bit of the drill string. At step 208, a pressure fluid is pumped down the substantially vertical well bore when the drainage bore is being drilled. In particular embodiments the pressure fluid may comprise compressed gas. The pressure fluid mixes with the drilling fluid to form a fluid mixture returning up the articulated well bore. The fluid mixture returning up the articulated well bore forms a frictional pressure that may resist flow of fluid from the subterranean zone. The well system includes a bottom hole pressure that comprises the frictional pressure. The bottom hole pressure may also comprise hydrostatic pressure from fluids in the articulated well bore. The bottom hole pressure may be greater than, less than or equal to a pressure from subterranean zone fluid.

At step 210, the bottom hole pressure is monitored. At step 212, the flow rate of the pressure fluid pumped down the substantially vertical well bore is varied in order to vary the frictional pressure. The composition of the pressure fluid may also be varied to vary the frictional pressure. Variation in the frictional pressure results in a variation of the bottom hole pressure.

Although the present invention has been described in detail, various changes and modifications may be suggested to one skilled in the art. It is intended that the present invention encompass such changes and modifications as falling within the scope of the appended claims.

What is claimed is:

1. A method for controlling pressure of a dual well system, comprising:

drilling a substantially vertical well bore from a surface to a subterranean zone;

drilling an articulated well bore from the surface to the subterranean zone using a drill string, the articulated well bore horizontally offset from the substantially vertical well bore at the surface and intersecting the substantially vertical well bore at a junction proximate the subterranean zone;

drilling a drainage bore from the junction into the subterranean zone;

pumping a drilling fluid through the drill string when drilling the drainage bore, the drilling fluid exiting the drill string proximate a drill bit of the drill string;

pumping a pressure fluid down the substantially vertical well bore when drilling the drainage bore, the pressure fluid comprising a liquid and mixing with the drilling fluid to form a fluid mixture returning up the articulated well bore;

wherein the fluid mixture returning up the articulated well bore forms a frictional pressure that resist fluid flow from the subterranean zone.

2. The method of claim 1, wherein the articulated well bore has a bottom hole pressure, the bottom hole pressure comprising the frictional pressure, and wherein the bottom hole pressure is greater than a pressure from subterranean zone fluid.

3. The method of claim 1, wherein the articulated well bore has a bottom hole pressure, the bottom hole pressure comprising the frictional pressure, and wherein the bottom hole pressure is less than a pressure from subterranean zone fluid.

4. The method of claim 1, wherein the articulated well bore has a bottom hole pressure, the bottom hole pressure comprising the frictional pressure, and wherein the bottom hole pressure is equal to a pressure from the subterranean zone fluid.

5. The method of claim 1, wherein the pressure fluid comprises compressed gas.

6. The method of claim 1, further comprising varying the flow rate of the pressure fluid to vary the frictional pressure.

7. The method of claim 1, further comprising changing the composition of the pressure fluid to vary the frictional pressure.

8. The method of claim 1, wherein the subterranean zone comprises a coal seam.

9. The method of claim 1, wherein the subterranean zone comprises an oil or gas reservoir.

10. A method for controlling pressure of a dual well system, comprising:

drilling a substantially vertical well bore from a surface to a subterranean zone;

drilling an articulated well bore from the surface to the subterranean zone using a drill string, the articulated well bore horizontally offset from the substantially vertical well bore at the surface and intersecting the substantially vertical well bore at a junction proximate the subterranean zone;

drilling a drainage bore from the junction into the subterranean zone;

pumping a drilling fluid through the drill string when drilling the drainage bore, the drilling fluid exiting the drill string proximate a drill bit of the drill string;

pumping a pressure fluid down the articulated well bore when drilling the drainage bore, the pressure fluid mixing with the drilling fluid after the drilling fluid exits the drill string to form a fluid mixture returning up the substantially vertical well bore;

wherein the fluid mixture returning up the substantially vertical well bore forms a frictional pressure that resist fluid flow from the subterranean zone.

11. The method of claim 10, wherein the articulated well bore has a bottom hole pressure, the bottom hole pressure comprising the frictional pressure, and wherein the bottom hole pressure is greater than a pressure from subterranean zone fluid.

12. The method of claim 10, wherein the articulated well bore has a bottom hole pressure, the bottom hole pressure comprising the frictional pressure, and wherein the bottom hole pressure is less than a pressure from subterranean zone fluid.

13. The method of claim 10, wherein the articulated well bore has a bottom hole pressure the bottom hole pressure comprising the frictional pressure, and wherein the bottom hole pressure is equal to a pressure from subterranean zone fluid.

14. The method of claim 10, wherein the pressure fluid comprises compressed gas.

15. The method of claim 10, further comprising varying the flow rate of the pressure fluid to vary the frictional pressure.

16. The method of claim 10, further comprising changing the composition of the pressure fluid to vary the frictional pressure.

17. The method of claim 10, wherein the subterranean zone comprises a coal seam.

18. The method of claim 10, wherein the subterranean zone comprises an oil or gas reservoir.

19. A dual well system for controlling pressure in the wells, comprising:

a substantially vertical well bore extending from a surface to a subterranean zone;

an articulated well bore extending from the surface to the subterranean zone, the articulated well bore horizontally offset from the substantially vertical well bore at the surface and intersecting the substantially vertical well bore at a junction proximate the subterranean zone;

a drainage bore extending from the junction into the subterranean zone;

a drill string disposed within the articulated well bore, the drill string used to drill the drainage bore;

a drilling fluid provided through the drill string and exiting the drill string proximate a drill bit of the drill string, a pressure fluid provided down the substantially vertical well bore, the pressure fluid comprising a liquid and mixing with the drilling fluid to form a fluid mixture returning up the articulated well bore;

wherein the fluid mixture returning up the articulated well bore forms a frictional pressure that resist fluid flow from the subterranean zone.

20. The system of claim 19, wherein the articulated well bore has a bottom hole pressure, the bottom hole pressure comprising the frictional pressure, and wherein the bottom hole pressure is greater than a pressure from subterranean zone fluid.

21. The system of claim 19, wherein the articulated well bore has a bottom hole pressure, the bottom hole pressure comprising the frictional pressure, and wherein the bottom hole pressure is less than a pressure from subterranean zone fluid.

22. The system of claim 19, wherein the articulated well bore has a bottom hole pressure, the bottom hole pressure comprising the frictional pressure, and wherein the bottom hole pressure is equal to a pressure from subterranean zone fluid.

23. The system of claim 19, wherein the pressure fluid comprises compressed gas.

24. The system of claim 19, wherein the subterranean zone comprises a coal seam.

25. The system of claim 19, wherein the subterranean zone comprises an oil or gas reservoir.

26. The system of claim 19, further comprising a pump operable to provide the pressure fluid down the substantially vertical well bore and to vary the flow rate of the pressure fluid to vary the frictional pressure.

27. A dual well system for controlling pressure in the wells, comprising:

a substantially vertical well bore extending from a surface to a subterranean zone;

an articulated well bore extending from the surface to the subterranean zone, the articulated well bore horizontally offset from the substantially vertical well bore at the surface and intersecting the substantially vertical well bore at a junction proximate the subterranean zone;

a drainage bore extending from the junction into the subterranean zone;

a drill string disposed within the articulated well bore, the drill string used to drill the drainage bore;

a drilling fluid provided through the drill string and exiting the drill string proximate a drill bit of the drill string;

a pressure fluid provided down the articulated well bore, the pressure fluid mixing with the drilling fluid after the drilling fluid exits the drill string to form a fluid mixture returning up the substantially vertical well bore;

wherein the fluid mixture returning up the substantially vertical well bore forms a frictional pressure that resist fluid flow from the subterranean zone.

28. The system of claim 27, wherein the articulated well bore has a bottom hole pressure, the bottom hole pressure comprising the frictional pressure, and wherein the bottom hole pressure is greater than a pressure from subterranean zone fluid.

29. The system of claim 27, wherein the articulated well bore has a bottom hole pressure, the bottom hole pressure comprising the frictional pressure, and wherein the bottom hole pressure is less than a pressure from subterranean zone fluid.

30. The system of claim 27, wherein the articulated well bore has a bottom hole pressure, the bottom hole pressure comprising the frictional pressure, and wherein the bottom hole pressure is equal to a pressure from subterranean zone fluid.

31. The system of claim 27, wherein the pressure fluid comprises compressed gas.

32. The system of claim 27, wherein the subterranean zone comprises a coal seam.

33. The system of claim 27, wherein the subterranean zone comprises an oil or gas reservoir.

34. The system of claim 27, further comprising a pump operable to provide the pressure fluid down the articulated well bore and to vary the flow rate of the pressure fluid to vary the frictional pressure.

35. A method for controlling pressure of a dual well system, comprising:

pumping a pressure fluid down a substantially vertical well bore from a surface, the substantially vertical well bore extending from the surface to a subterranean zone, the pressure fluid comprising a liquid;

pumping a drilling fluid through an articulated well bore from the surface, the articulated well bore horizontally offset from the substantially vertical well bore at the surface and intersecting the substantially vertical well bore at a junction proximate the subterranean zone;

wherein the pressure fluid mixes with the drilling fluid to form a fluid mixture returning up the articulated well bore; and wherein the return of the fluid mixture up the articulated well bore forms a frictional pressure that resists fluid flow from the subterranean zone.

36. The method of claim 35, wherein the pressure fluid is pumped down the substantially vertical well bore while making connections to a drill string in the articulated well bore.

37. The method of claim 35, wherein the pressure fluid is pumped down the substantially vertical well bore while tripping a drill string in the articulated well bore.

* * * * *

UNITED STATES PATENT AND TRADEMARK OFFICE

CERTIFICATE OF CORRECTION

PATENT NO. : 7,073,595 B2
APPLICATION NO. : 10/244082
DATED : July 11, 2006
INVENTOR(S) : Joseph Alan Zupanick and Frank Merendino, Jr.

It is certified that error appears in the above-identified patent and that said Letters Patent is hereby corrected as shown below:

U.S. Patent Documents, page 2, column 1, line 13, delete "12/1955" and insert -- 3/1952 --.

U.S. Patent Documents, page 2, column 2, line 11, delete "6/1982" and insert -- 6/1992 --.

U.S. Patent Documents, page 3, column 1, line 64, delete "3/1997" and insert -- 4/1997 --.

U.S. Patent Documents, page 3, column 2, line 70, delete "250/269.2" and insert -- 250/269.3 --.

U.S. Patent Documents, page 4, column 1, line 4, delete "250/269.3" and insert -- 250/269.2 --.

U.S. Patent Documents, page 4, column 1, line 14, after "Thompson et al." insert -- 324/338 --.

Foreign Patent Documents, page 4, column 1, before line 43, insert -- CA 2 278 735 – 01/1998 --.

Foreign Patent Documents, page 4, column 1, before line 43, insert -- CH 653 741 – 01/1986 --.

Foreign Patent Documents, page 4, column 1, after line 50, insert -- GB 2 25 033 – 10/1992 --.

Foreign Patent Documents, page 4, column 1, after line 58, insert -- WO 98/35133 – 08/1998 --.

Foreign Patent Documents, page 4, column 1, after line 61, insert -- WO 01/44620 – 06/2001 --.

Foreign Patent Documents, page 4, column 1, after line 63, insert -- WO 02/061238 – 08/2002 --.

Foreign Patent Documents, page 4, column 1, after line 63, insert -- WO 03/102348 – 12/2003 --.

Other Publications, page 4, column 2, line 17, delete "Wellbone" and insert -- Wellbore --.

Other Publications, page 5, column 1, line 40, delete "Zunpanick," and insert -- Zupanick, --.

Signed and Sealed this
Eighteenth Day of December, 2012

David J. Kappos

David J. Kappos
*Director of the United States Patent and Trademark Office*

Other Publications, page 5, column 1, line 42, delete "10//761,629," and insert -- 10/761,629, --.

Other Publications, page 5, column 1, line 60, delete "Virgina" and insert -- Virginia --.

Other Publications, page 5, column 1, line 61, delete "Environmenal" and insert -- Environmental --.

Other Publications, page 5, column 2, line 14, delete "of" and insert -- or --.

Other Publications, page 5, column 2, line 60, delete "Stayon," and insert -- Stayton, --.

Other Publications, page 6, column 1, line 7, delete "1949-1950," and insert -- 1946-1950, --.

Other Publications, page 6, column 1, line 25, delete "Compant," and insert -- Company, --.

Other Publications, page 6, column 1, line 31, before "American" insert -- The --.

Other Publications, page 6, column 1, line 34, delete "2004" and insert -- 2001, --.

Other Publications, page 6, column 1, line 60, delete "Suraface," and insert -- Surface, --.

Other Publications, page 6, column 2, line 27, delete "Operatioal" and insert -- Operational --.

Other Publications, page 6, column 2, line 28, delete "Jouranl," and insert -- Journal, --.

Other Publications, page 7, column 1, line 23, delete "Mutli-Sean" and insert -- Multi-Seam --.

Other Publications, page 7, column 1, line 41, delete "Assesment of Continous Unconvention)" and insert -- Assessment of Continuous (Unconventional) --.

Other Publications, page 7, column 2, line 1, delete "Let' Get" and insert -- Let's Get --.

Other Publications, page 7, column 2, line 19, delete "Corpyright" and insert -- Copyright --.

Other Publications, page 7, column 2, line 22, delete "Mutilateral" and insert -- Multilateral --.

Other Publications, page 7, column 2, line 23, delete "Engineering" and insert -- Engineer --.

Other Publications, page 7, column 2, line 25, delete "Mutli-Lateral" and insert -- Multi-Lateral --.

Other Publications, page 7, column 2, line 55, delete "Stephens" and insert -- Stephen --.

Other Publications, page 8, column 1, line 2, delete "Multiateral" and insert -- Multilateral --.

Other Publications, page 8, column 1, line 28, delete "Sloutions" and insert -- Solutions --.

Other Publications, page 8, column 1, line 30, delete "Acheive" and insert -- Achieve --.

Other Publications, page 8, column 1, line 38, delete "Abu Chabi," and insert -- Abu Dhabi, --.

Other Publications, page 8, column 1, line 43, delete "SPe/IADC" and insert -- SPE/IADC --.

Other Publications, page 8, column 1, line 44, delete "203," and insert -- 2003 --.

Other Publications, page 8, column 1, line 45, delete "Exhibtion" and insert -- Exhibition --.

Other Publications, page 8, column 1, line 45, delete "Abu Chabi," and insert -- Abu Dhabi, --.

Other Publications, page 8, column 1, line 52, delete "Synder," and insert -- Snyder, --.

Other Publications, page 8, column 2, line 3, delete "Nothern" and insert -- Northern --.

Other Publications, page 8, column 2, line 7, delete "Jeffery J." and insert -- Jeffrey J. --.

Other Publications, page 8, column 2, line 21, delete "Calender" and insert -- Calendar --.

Other Publications, page 8, column 2, line 29, delete "Capabilites," and insert -- Capabilities, --.

Other Publications, page 8, column 2, lines 30-31, delete "reservoirengineergineering" and insert -- reservoirengineering --.

Other Publications, page 8, column 2, line 34, delete "Sothwest," and insert -- Southeast --.

Other Publications, page 8, column 2, line 37, delete "Jeffery" and insert -- Jeffrey --.

Other Publications, page 8, column 2, line 39, delete "Twonbly," and insert -- Twombly, --.

Other Publications, page 8, column 2, line 41, delete "Comparsion" and insert -- Comparison --.

Other Publications, page 8, column 2, line 42, delete "Devloped" and insert -- Developed --.

Other Publications, page 9, column 1, line 5, delete "Interantional" and insert -- International --.

Other Publications, page 9, column 1, lines 9-10, delete "(5 pages0" and insert -- (5 pages) --.

Column 1, line 33, delete "connection" and insert -- connecting --.

Column 7, line 40, Claim 4, delete "from the" and insert -- from --.

Column 8, line 20, Claim 13, delete "pressure" and insert -- pressure, --.